US007416110B2

(12) United States Patent
Campbell

(10) Patent No.: US 7,416,110 B2
(45) Date of Patent: Aug. 26, 2008

(54) APPARATUS FOR COLLECTING PARTICULATE MATERIAL

(76) Inventor: John Campbell, 58 Inchbonnie Road, South Woodham Ferrer, Essex (GB) CM3 5GE ( * ) Notice: Subject to any disclaimer, the term of this patent is extended or adjusted under 35 U.S.C. 154(b) by 302 days.

(21) Appl. No.: 10/509,551

(22) PCT Filed: Apr. 1, 2003

(86) PCT No.: PCT/GB03/01431

§ 371 (c)(1),
(2), (4) Date: Sep. 28, 2004

(87) PCT Pub. No.: WO03/082724

PCT Pub. Date: Oct. 9, 2003

(65) Prior Publication Data

US 2005/0229942 A1 Oct. 20, 2005

(30) Foreign Application Priority Data

Apr. 2, 2002 (GB) ..... 0207575.2

(51) Int. Cl.
*A47G 29/12* (2006.01)

(52) U.S. Cl. ..... 232/43.3; 232/43.2; 198/498

(58) Field of Classification Search ..... 232/1 R, 232/43.2, 43.3, 30–31; 131/329, 232, 184.1; 110/259; 220/908, 908.3; 126/555; 198/498
See application file for complete search history.

(56) References Cited

U.S. PATENT DOCUMENTS

| | | | | | |
|---|---|---|---|---|---|
| 948,815 | A * | 2/1910 | Ehrlich | 232/31 |
| 3,421,495 | A * | 1/1969 | Winegardner | 126/555 |
| 4,360,947 | A * | 11/1982 | DeCosa et al. | 15/323 |
| 4,536,023 | A * | 8/1985 | Sutter | 294/9 |
| 4,704,764 | A * | 11/1987 | Metelko, Jr. | 15/301 |
| 5,388,535 | A * | 2/1995 | Eshleman | 110/255 |
| 5,513,883 | A * | 5/1996 | Segla | 294/9 |
| 6,006,744 | A * | 12/1999 | Taylor | 126/543 |
| 6,230,633 | B1 * | 5/2001 | Magaldi et al. | 110/189 |
| 2003/0147566 | A1 * | 8/2003 | Brocking | 383/84 |
| 2004/0231685 | A1 * | 11/2004 | Patel et al. | 131/365 |
| 2005/0155975 | A1 * | 7/2005 | Belot | 220/736 |

FOREIGN PATENT DOCUMENTS

| | | |
|---|---|---|
| JP | 08 225283 A | 9/1996 |
| JP | 10 305 984 | 11/1998 |

* cited by examiner

*Primary Examiner*—William L. Miller
(74) *Attorney, Agent, or Firm*—Seyfarth Shaw LLP

(57) ABSTRACT

An apparatus for collecting particulate material has a collection tray (1) and a fire-resistant collection reservoir (21, 22, 23). A scraper blade (24) is attached to a carriage (7) which is arranged to be driven by an electrical motor along the base of the tray (1) so as to sweep particulate material into the reservoir (21, 22, 23). A pivotal lid normally closes an opening into the reservoir (21, 22, 23) until the scraper blade is ready to sweep particulate material into the reservoir, whereupon the lid is opened to receive the swept particulate material. Actuation of the lid for the reservoir may be operated by electromechanical switches or by a solenoid (60).

19 Claims, 12 Drawing Sheets

APPARATUS FOR COLLECTING PARTICULATE MATERIAL

BACKGROUND OF THE INVENTION (1) Field of the Invention; and

This invention relates to an apparatus for collecting particulate material such as dust/debris.

(2) Description of the Related Art.

For certain processes, such as the use of an escalator-type conveyor in a public arena, the collection and disposal of accumulated dust, oil, debris etc., is a mandatory safety requirement, to minimise potential fire hazards. Accumulated debris naturally falls off the underside of the conveyor and needs to be collected and contained. This objective is usually achieved by fitting static, open-topped, dust collection trays, to the underside of the conveyors. Such trays are well known and there are many types of trays for numerous types of applications. This type of arrangement satisfactorily achieves the aim of collecting the dust and debris. However, in order to minimise fire hazards, and to ensure that fire safety regulations are not breached, it is required that, the trays receive regular, manual inspection and manual cleaning. This is expensive, in terms of time and labour, and sometimes the accepted fire risk levels are still exceeded. The cleaning operators are also exposed to regular contact with, potentially, harmful substances, from the accumulated dust oil debris etc.

The objectives of this invention are to:

1) Reduce the time and costs involved in inspecting and cleaning the collection tray.

2) Reduce the levels of fire risks, due to the accumulation of un-cleared dust/debris.

3) Reduce the exposure levels of the cleaning operators to potentially harmful substances.

SUMMARY OF THE INVENTION

According to a first aspect of this invention there is provided an apparatus for collecting particulate material comprising a collection tray, a fire resistant collection reservoir associated with said collection tray, and means for moving particulate material from said collection tray into said fire resistant collection reservoir.

Preferably, said reservoir is a container having a selectably operable lid.

Advantageously, said reservoir includes a removable collection unit.

Conveniently, said reservoir is located beneath one end of said tray.

Advantageously, said moving means include a motor driven scraper carriage unit which includes scraper blade means arranged to reciprocatingly move particulate material from an inside base portion of said tray and into said reservoir.

Preferably, when said scraper blade means is positioned above said reservoir, means are provided for opening said reservoir lid so that particulate moved by said blade is deposited into said reservoir.

In one embodiment, the means for opening said reservoir lid includes a pivotal lid having an abutment member arranged to be contacted by a member attached to said scraper carriage unit for causing said lid to pivotally open.

In an alternative embodiment, the means for opening said reservoir lid includes a pivotal lid arranged to be opened and closed by electro-magnetic means activatable by scraper carriage unit position detecting means.

Preferably, said electro-magnetic means is an electrical solenoid coupled with said lid.

Advantageously, there is provided detector means to determine the open and closed states of the lid and control means for controlling motion of said moving means whereby, if said lid fails to open or close, movement of said moving means is terminated.

Advantageously, when said scraper blade means is above said reservoir and said lid is open, means are provided for cleaning the scraper blade means, whereby particulate and dirt therefrom is deposited into said reservoir.

Preferably, when said scraper blade means reciprocatingly re-traverses along said tray away from said reservoir, means are provided for closing said reservoir lid and for lifting said scraper blade means away from said inside base portion of said tray so that particulate is not moved in a direction away from said reservoir.

Advantageously, when said scraper blade means is arranged to reciprocatingly move particulate material toward and into said reservoir, means are provided for ensuring rigidity of said scraper blade means and, preferably, said means are provided for maintaining said scraper blade means orthogonally to the inside base portion of said tray.

Preferably, means are provided for limiting the range of motion of said moving means.

Advantageously, said moving means is controllable by timer means to effect reciprocation of said moving means.

According to a second aspect of this invention there is provided a method of collecting particulate material including the steps of providing a collection tray into which particulate material is deposited, arranging a fire-resistant collection reservoir to be associated with said collection tray, said fire-resistant collection reservoir having a lid, including the steps of providing means for moving particulate material toward said fire-resistant collection reservoir, opening the lid of said reservoir and depositing said particulate into said reservoir.

Preferably, the method further includes the step of lifting said moving means, moving said moving means away from said reservoir and closing said lid.

Thus, this invention provides a time-controlled, automatic, mechanised apparatus having a particulate (dust/debris) collection tray with a combined fire resistant collection unit (reservoir). The accumulated dust/debris within the collection tray is automatically moved into a fire- proof collection unit. This is achieved by utilising an automatic, timed, mechanically driven, scraper device, which is located within the dust tray. The scraping process, along the tray, automatically engages, and leaves secure, the fire resistant collection unit, into which the scraped dust, debris, oil, grease etc. is deposited. The fact that the collection unit is fire resistant means that the accumulated dust/debris etc. can be kept safely within it, which means it need only to be emptied at much longer intervals. Thus the tray is regularly cleaned via an automatic timed mechanical device, and the accumulated dust/debris, needs clearing from site less frequently; thereby achieving the objectives as identified above.

Preferably the tray and components will be made of fire resistant and/or fireproof materials. The size and dimensions of the tray determined to suit the size, and appropriate collection area, of the conveyor it is to be fitted to.

BRIEF DESCRIPTION OF THE DRAWINGS

The invention will now be described, by way of example, with reference to the accompanying drawings in which.

In the Figures like reference numerals denote like parts.

DETAILED DESCRIPTION OF THE PREFERRED EMBODIMENT

Figure 1:
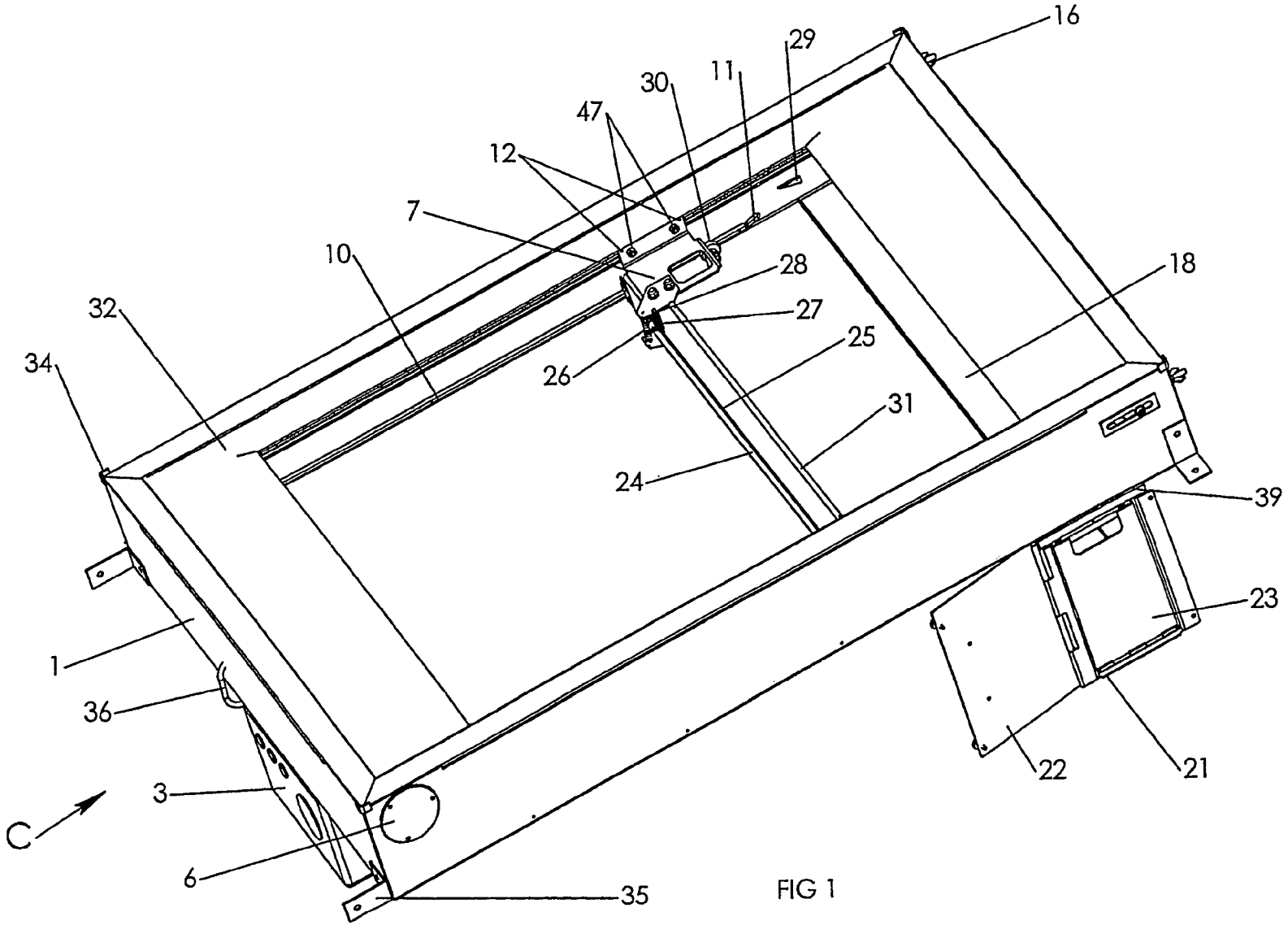
FIG. 1 shows a perspective view of an apparatus in accordance with this invention when viewed from above, with the dust tray lid 32 in position.

It is to be understood that in the drawings, dust tray side panels where required or desired have been removed for clarity.

FIG. 1 shows the apparatus viewed from above and fitted with a dust tray lid 32.

The tray lid 32 has angled flanges sloping in towards the base of the dust tray 1. The flanges of the tray lid 32 are angled to achieve three objectives:

To protect and prevent debris/dirt build up over the areas which cannot be cleaned by the movement of the scraper blade 24 i.e. those areas at the ends and immediate sides of the tray 1.

To direct dust/debris into the base of the tray 1

To minimise any dust/debris build up on the tray lid 32.

Figure 2:
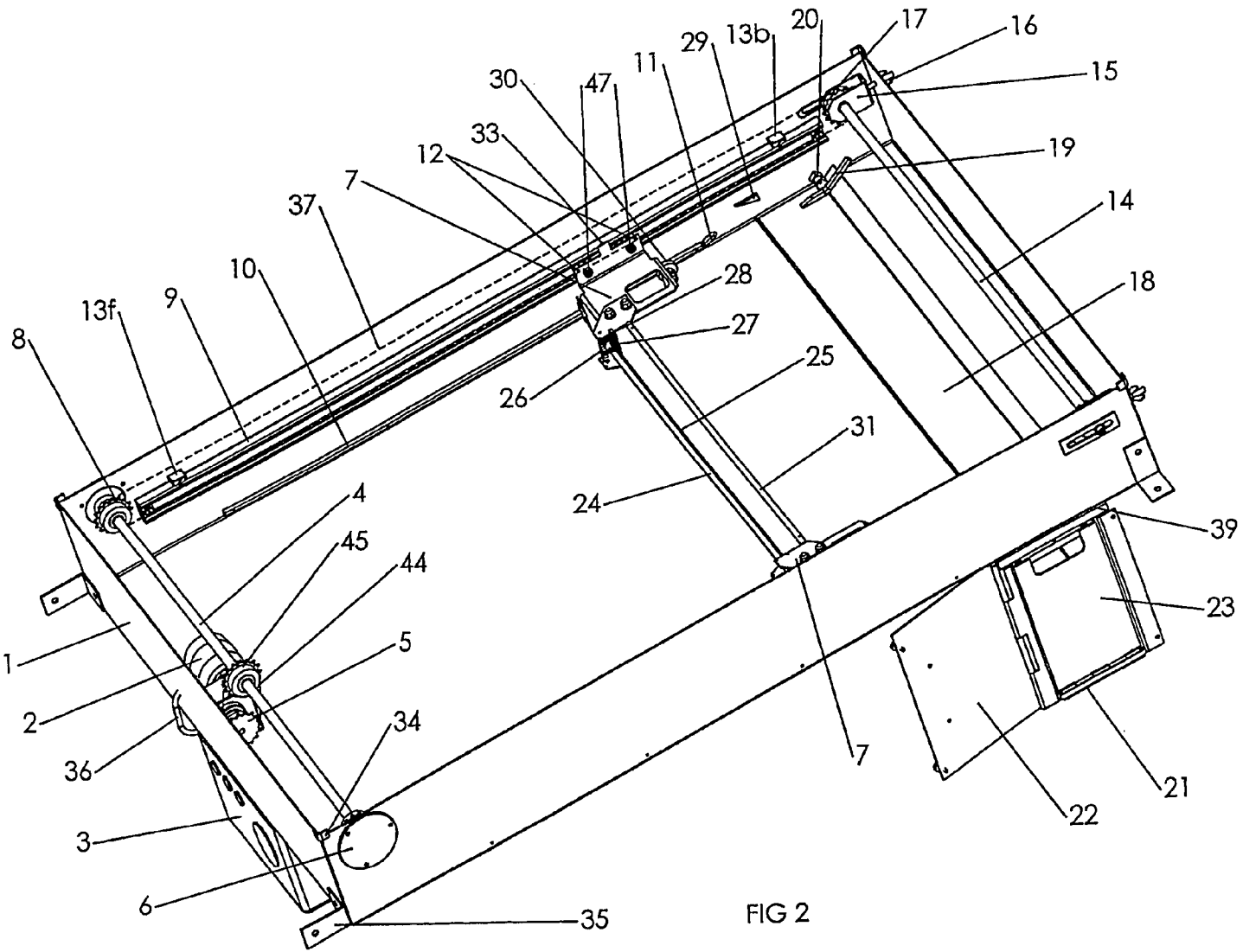
FIG. 2 shows a perspective view of an apparatus in accordance with this invention when viewed from above, with the dust tray lid removed for clarity.

FIG. 2 shows the apparatus with the tray lid 32 removed.

The main body of the apparatus is made of a steel tray 1. The tray 1 can be free standing on a proprietary support, below a selected debris deposit/catchment area of the conveyor or mechanical item which, requires the need to have a dust/debris collection unit. Alternatively it can be attached to the underside of the conveyor or mechanical item by utilising an L-shaped bracket 35 and proprietary fixings to suit.

Attached externally to the tray 1 are three items:

The first external item is the dust tray lid 32 (shown in FIG. 1) which is secured in place by dust tray lid fixing brackets 34.

The second external item is a dust/debris hopper collection unit 21, which has an inner removable tray 23 and a hinged outer door 22. The hopper debris collection unit 21 is attached to the underside of the dust tray 1 by any suitable means and extends across an opening in the base of the tray 1. This opening in the tray base is covered with a pivotal hopper lid 18.

The third external item is an electronic control unit 3 attached to the front end of the tray 1 (The control unit 3 can be positioned to the side or separately to the tray 1 if necessary.) The function of the control unit 3 is to control the timing and the stopping and starting of an electric motor 2, to which it is connected by a control cable 36.

The electric motor 2 operates a motor drive sprocket 5 which in turn operates a drive chain 44 which then operates a front axle drive sprocket 45 causing the front axle 4 to rotate in an associated bearing housing 6. The turning movement of the front drive axle 4 also turns scraper carriage chain sprocket 8 which in turn operates a scraper carriage chain 37 which rotates between the scraper carriage chain sprocket 8 and a scraper carriage tension axle sprocket 17.

The scraper carriage chain 37 is attached to a scraper carriage 7 with chain fixing pins 12. The scraper carriage 7 is then propelled forwards and backwards along a scraper carriage guide rail 9 on two opposed scraper carriage guide wheels 46 (shown in FIG. 3) which, are fixed to the scraper carriage 7 by respective scraper guide wheel fixing bolts 47.

Figure 3:
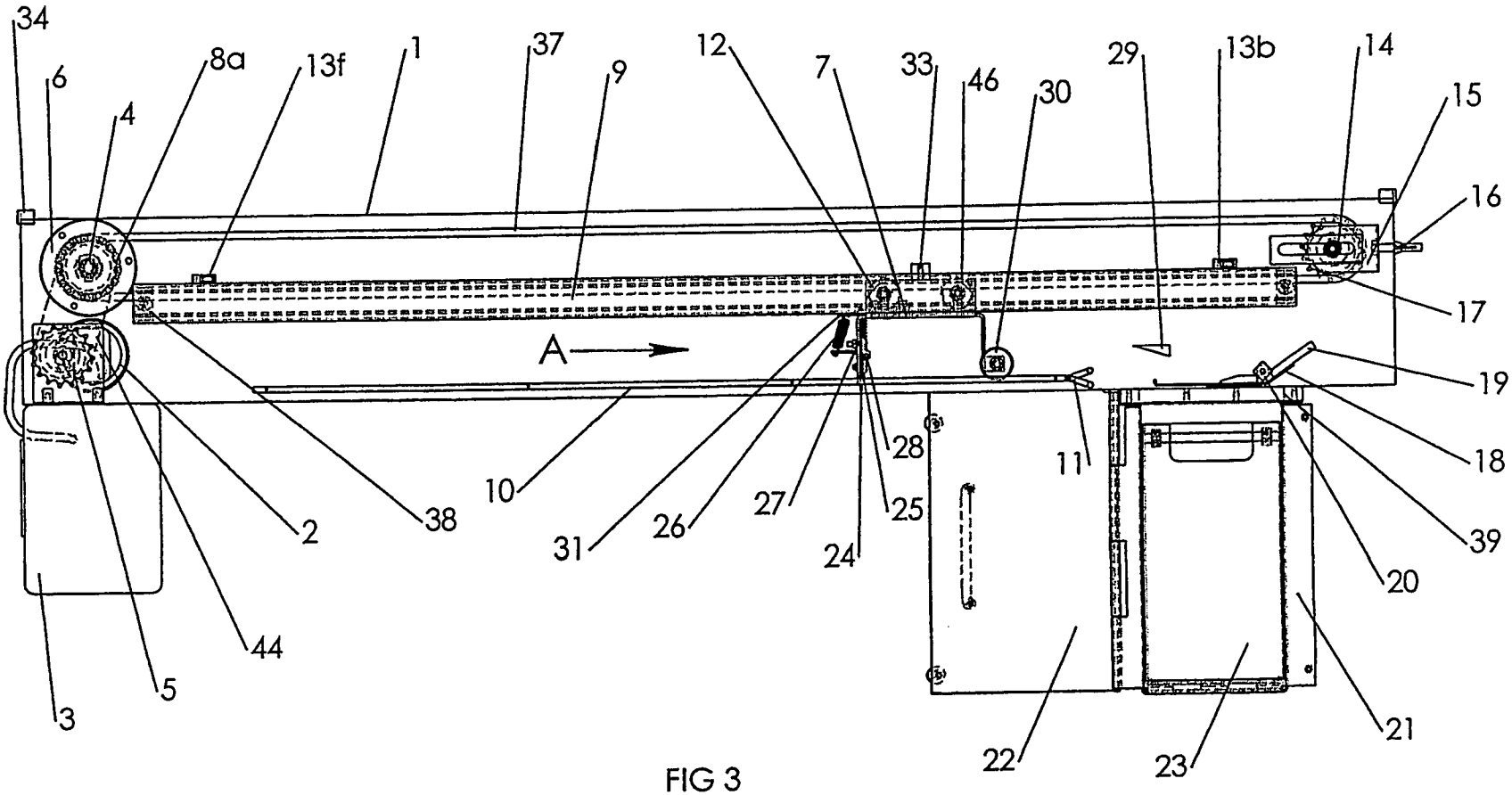
FIG. 3 shows a diagrammatic side view of a portion of the apparatus in one operational position.

FIG. 3 shows a side view of the device with the scraper blade 24 travelling from left to right as shown by arrow-headed line A. The scraper blade 24 is preferably made of metal with a rubber or plastics lateral bottom edge which travels sufficiently closely (a few microns) to the bottom of the tray to sweep small particles therefrom.

FIG. 3 shows the scraper carriage 7, moving on its carriage guide wheels 46, as it travels along the carriage guide rail 9. Also shown are front and back limit switches 13F and 13B respectively which are connected to the control unit 3 by electrical cabling (not shown for clarity) and are activated by a limit switch actuator 33 mounted on guide rail 9. The activation of the limit switches 13F and 13B signifies to the control unit the position of the scraper carriage 7. The control unit is pre-programmed to stop and start the motor drive unit 2 in a forward or reverse mode dependant on which limit switch is activated. This process in conjunction with any pre-set timings controls the start, finish and number of cleaning cycles for the scraper cleaning mechanism.

The scraper blade 24 is maintained to be substantially orthogonal to the base of the tray 1 as it travels along the scraper guide rail 10 thereby allowing the blade to scrape any debris along in front of it.

Figure 4:
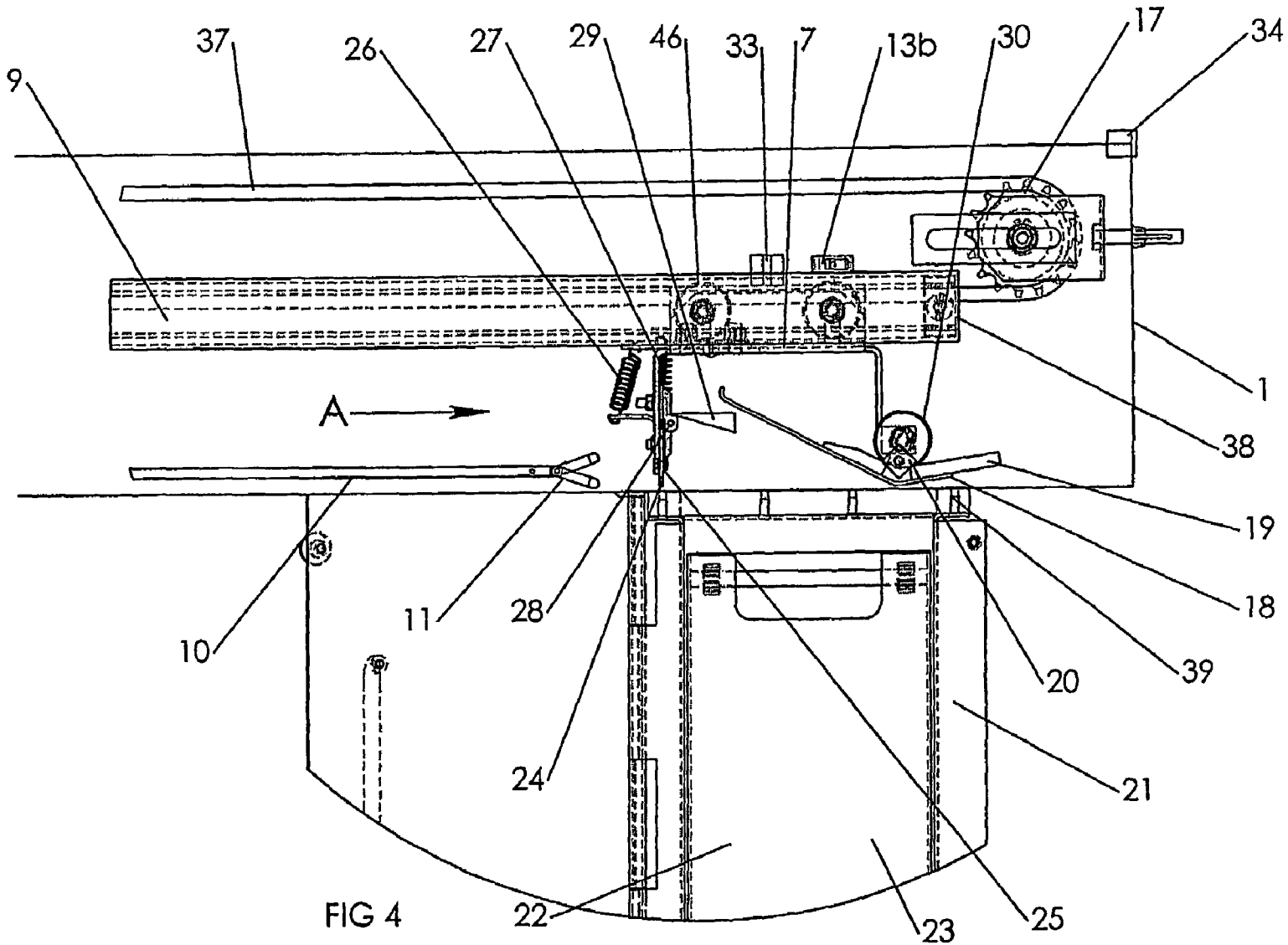
FIG. 4 shows a diagrammatic side view of a portion of the apparatus with a debris collecting hopper lid open and scraper blade approaching a debris deposit zone into a removable collection tray.

FIG. 4 shows the process of activation of a pivotal hopper lid 18, the cleaning blade 25 and the limit switch 13B.

A roller 30 is rotatably attached by a bracket to the scraper carriage 7 for use in pivoting the lid 18.

As the scraper carriage unit moves from left to right, as shown in FIG. 3, the roller 30 engages a hopper lid abutment 19 which causes the hopper lid 18 to pivot upwards on a pivot pin 20. The movement of the scraper carriage from left to right also moves the scraper blade 24 over the opening in a base of the tray 1. This allows any built up debris in front of the scraper blade 24 to fall into the removable inner tray 23 of the hopper unit 21. Attached to the front of the scraper blade is a sprung moveable cleaning blade 25. As the scraper carriage moves forward, the top of the cleaning blade 25 engages a tapered cleaner blade wedge 29 which forces the cleaning blade down on its spring 27. The downward movement of the cleaning blade 25 scrapes any stubborn residue off the scraper blade 24 into the removable collection unit 23 below. As the scraper reaches the end of its forward cleaning cycle the limit switch 13B is activated by the limit switch actuator 33 which causes the control panel to stop the electric motor and to put it into reverse mode ready for the return leg of the cleaning cycle. In the event that the limit switch 13B fails to activate, the leading carriage guide wheel 46 is prevented from overrunning the guide rail by coming into contact with a carriage guide end stop 38. This action would cause an overload in the motor unit 2 which would be sensed by the electronic control unit 3 which would then turn off the motor.

Figure 5:
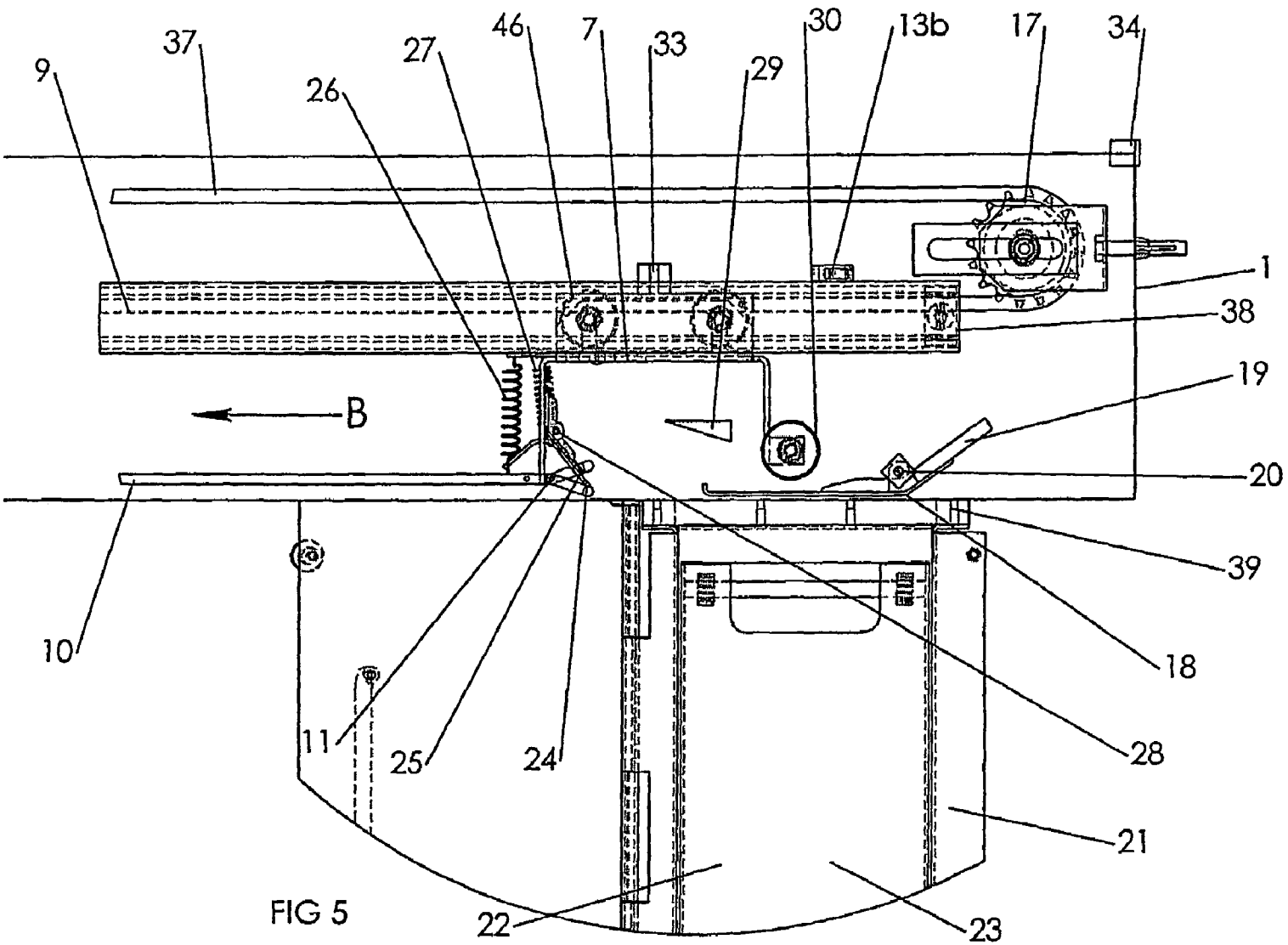
FIG. 5 shows a diagrammatic side view of a portion of the apparatus in another operational position thereof.

FIG. 5 shows a side view of the scraper 24 moving back along the dust tray 1 from right to left in the direction of arrow-headed line B away from the hopper debris collection unit 21 and engaging a scraper lift pivot 11.

FIG. 5 shows the hopper lid operating roller 30 having disengaged from the hopper lid abutment 19 as it moves along with the scraper carriage 7 away from the hopper collection unit 21. This movement in the opposite direction allows the hopper lid 18 to pivot back down into its closed position and the cleaning blade 25 to disengage from the taper wedge 29 and return to its normal position utilising the spring action of the cleaner blade spring 27.

Figure 7:
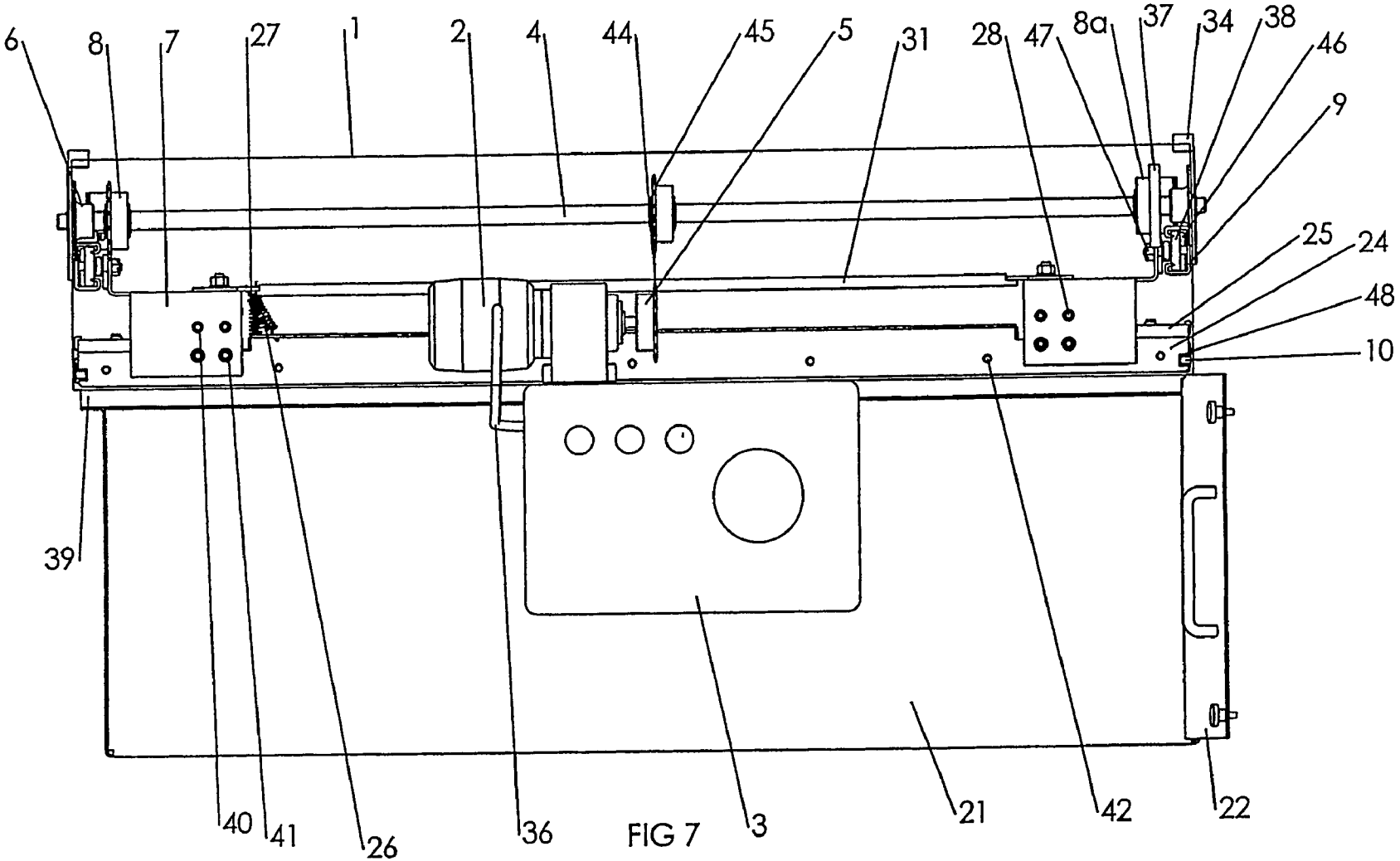
FIG. 7 shows an end view of the apparatus in the direction of arrow-headed line C shown in FIG. 1.
Figure 8:
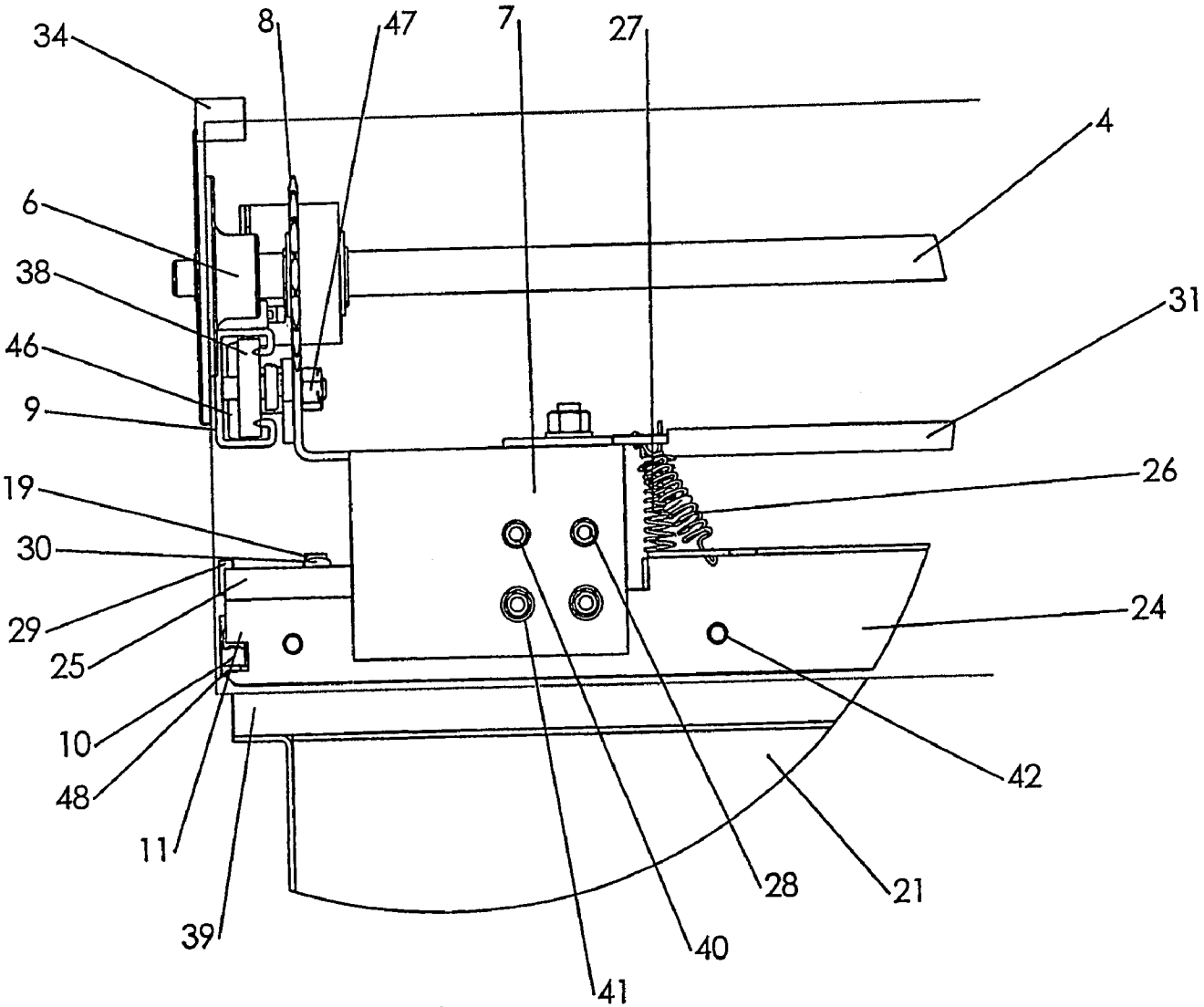
FIG. 8 shows an enlarged, detailed view of the left hand side of FIG. 7.

As the scraper blade moves along from right to left it engages a scraper lift pivot 11. The scraper blade 24 is designed with a notch 48 in each end (as shown in FIGS. 7 and 8) which allows it to travel along the scraper lift guide rail 10 in a substantially vertical position with respect to the base of the tray 1 when travelling in the cleaning direction from left to right, as shown by arrow-headed line A. However on the return leg of the cleaning cycle it is not considered preferable to be able to scrape/drag any residue debris away from the hopper unit 21 as this could cause an unacceptable build up of dirt/debris on the reverse side (downstream of the cleaning side) of the scraper blade 24. To avoid this event the scraper blade is designed to hinge in one direction (counter clockwise in FIG. 5) utilising a scraper hinge 28. On the return leg of the cleaning cycle from right to left (in the direction of arrow-headed line B), when the scraper blade 24 engages the scraper lift pivot 11, the scraper blade 24 is forced to hinge counter clockwise upwards, and the scraper blade side notches 48 (shown in FIGS. 7 and 8) do not engage the scraper lift guide rail 10. This action then forces the scraper blade to travel along in a raised hinged position on top of the scraper guide rail 10 and thus it cannot scrape or cause build up of debris on the reverse side of the scraper blade 24.

Figure 6:
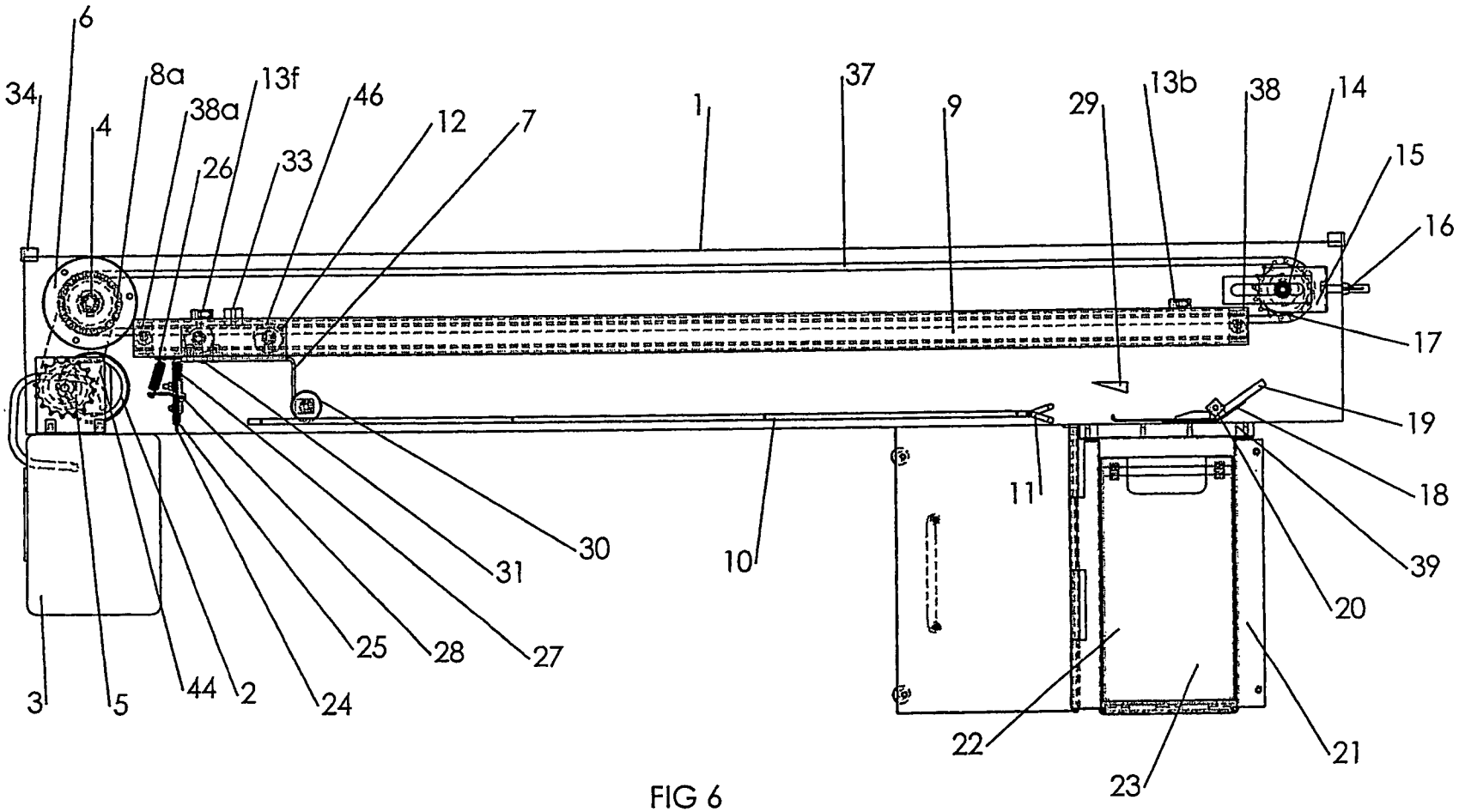
FIG. 6 shows a diagrammatic side view of the apparatus in which the scraper blade has dropped off the end of a scraper lift guide as it returns to its starting and finishing position for each complete cycle of clean.

FIG. 6 shows the scraper blade 24 having dropped off the end of the scraper lift guide rail 10 into a vertical position as it returns to its starting and finishing position for each complete cycle of clean.

The scraper blade 24 is assisted back into the vertical position by the contracting action of a scraper blade spring 26. As the scraper carriage 7 reaches the start finish point of its cleaning cycle the limit switch actuator 33 will engage the limit switch 13F which will initiate another pre-programmed set of instructions from the control panel 3. These instructions will either continue or end the cleaning cycle until the programme timer tells the control panel to restart the cleaning cycle. Once again the scraper carriage guide 7 is prevented from excess travel by a carriage guide end stop 38*a*.

FIG. 7 shows a cross section of the device viewed from the end of the control unit 3

This view shows opposing sides of the device arranged with an inter-connecting rod 31 between the two scraper carriages 7. Also shown is the scraper blade notch 48 notch at both ends of the scraper blade 24. It can be seen that the scraper notch 48 is in line with the scraper guide rail 10 and it is this notch which allows the scraper blade 24 to travel in a substantially vertical orientation along the scraper guide rail 10 and holds the blade in a substantially vertical direction when moving in the direction of arrow-headed line A.

FIG. 8 shows a detailed left hand cross section of FIG. 7 (scraper carriage chain 37 on scraper carriage sprocket 8 omitted for clarity).

FIG. 8 shows the scraper blade hinge 28 attached to the scraper carriage 7 and scraper blade 24 via bolt fixings 40. Within an end portion of the scraper carriage 7 are large holes 41, which allow clearance for bolt fixings which attach the scraper hinge 28 to the scraper blade 24 through the lower bolt holes 40. This clearance permits the scraper hinge 28 to be mounted substantially flush against, but not past, the vertical of a back plate of the scraper carriage 7. This, therefore, allows the scraper blade 24 to maintain a substantially vertical position during the forward cleaning cycle.

Also seen in FIG. 8 are cleaning blade fixing bolts 42, which are used to locate the cleaning blade 25 in slotted holes. The slotted holes within the cleaning blade 25 allow it to move up and down as it is pushed downwardly by the taper wedge 29 and pulled back up by the action of the cleaning blade spring 27.

At a lower part of the FIG. 8 can be seen a hopper fixing plate 39 to which the hopper 21 attaches.

Figure 9:
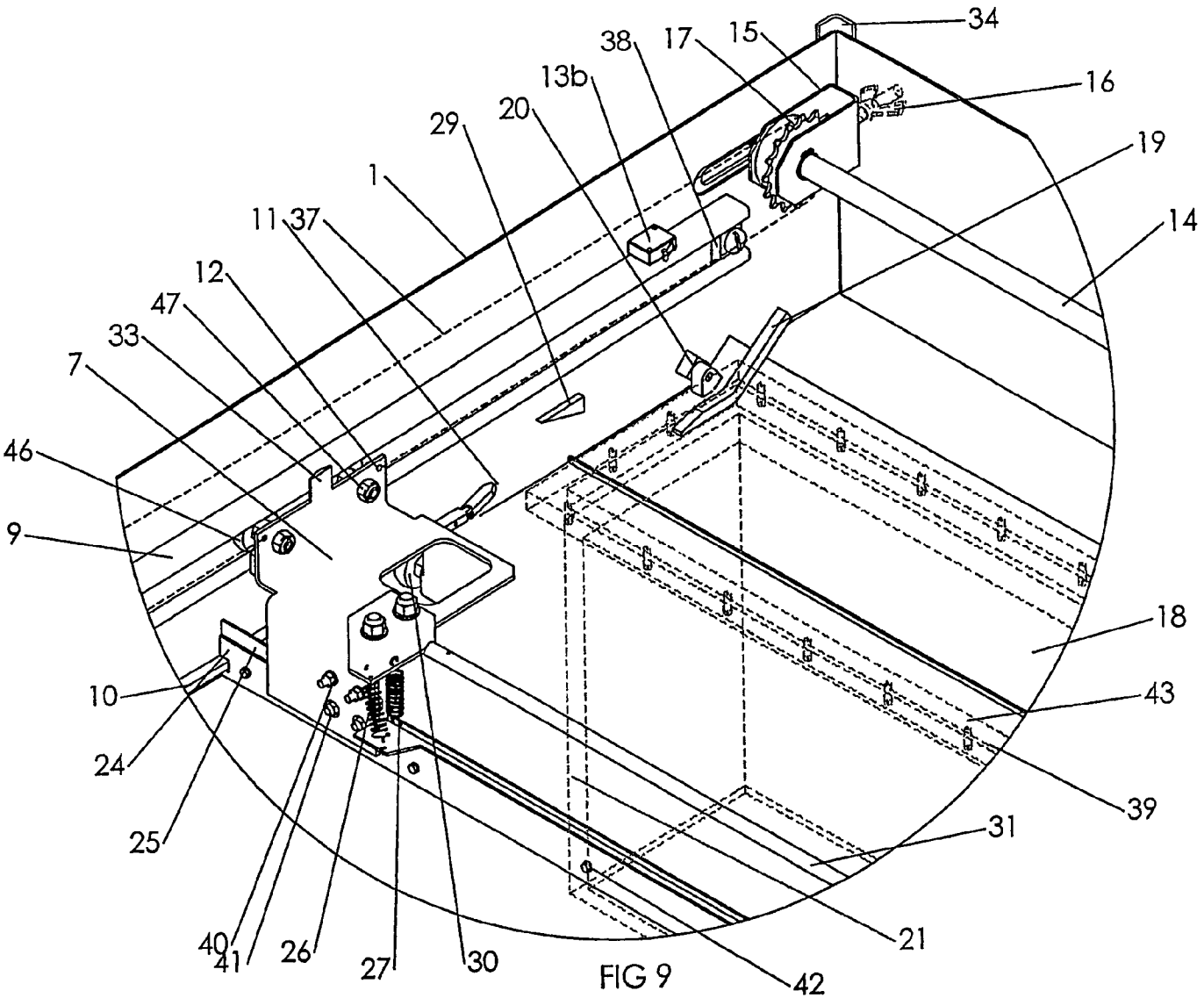
FIG. 9 shows an enlarged, detailed view of the apparatus, demonstrating the position and fixing arrangements for a debris-collecting hopper.

FIG. 9 shows a cross section view of the apparatus showing the position and fixing arrangements for the debris-collecting hopper 21.

FIG. 9 shows the hopper unit fixed onto the bottom of the tray 1 via fixing bolts through fixing plate screw holes 43 in the hopper fixing plate 39.

Also shown in FIG. 9 is the detail of a tension axle bracket 15, which holds a tension axle 14 and is adjusted via a screw threaded tension axle adjuster 16.

Figure 10:
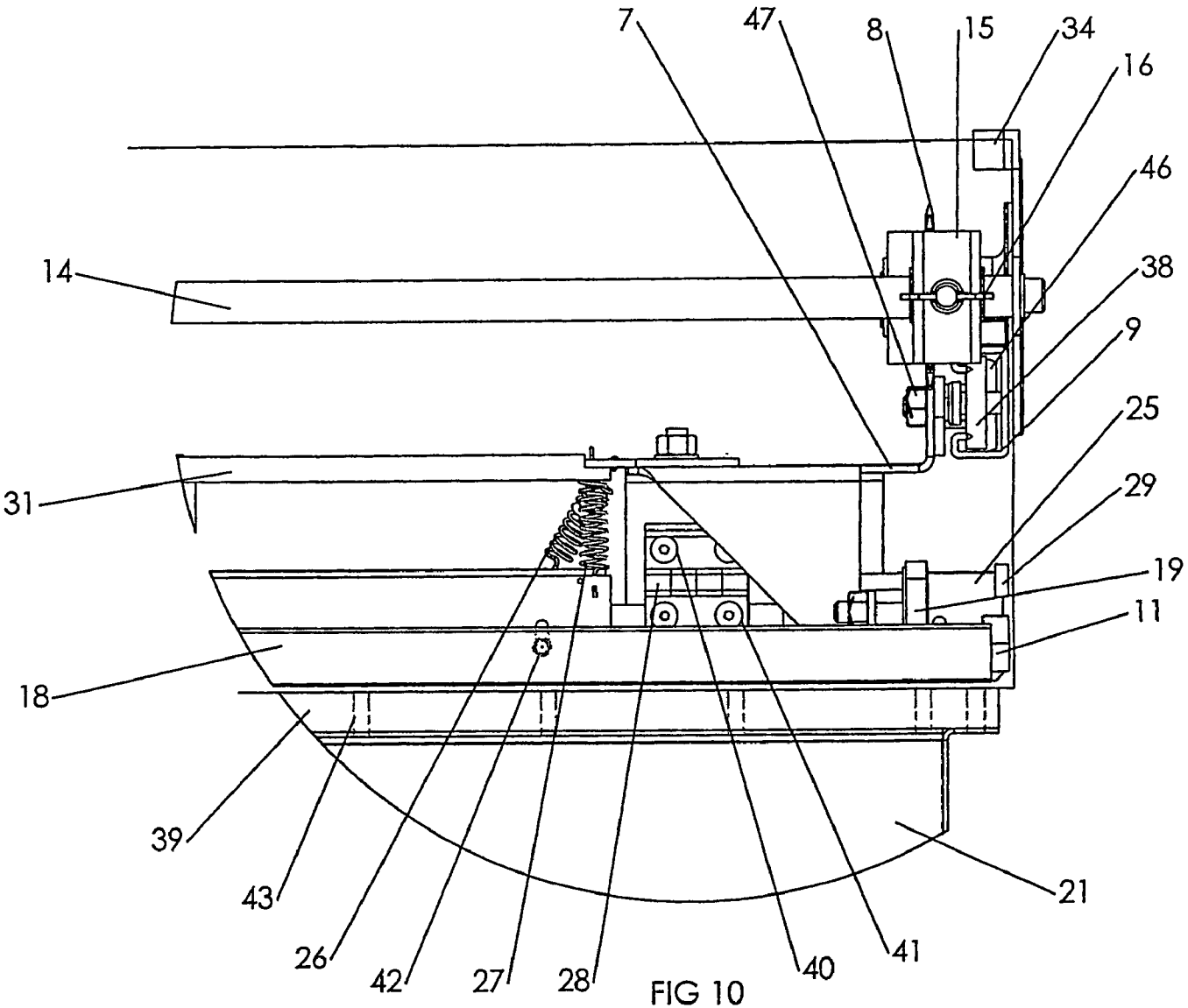
FIG. 10 shows an enlarged detailed front view of the scraper blade.

FIG. 10 shows a front view of the scraper blade 24 with the fixing arrangement for the scraper blade hinge 28 and cleaning blade 25 in slotted holes on bolt fixing points 42.

Figure 11:
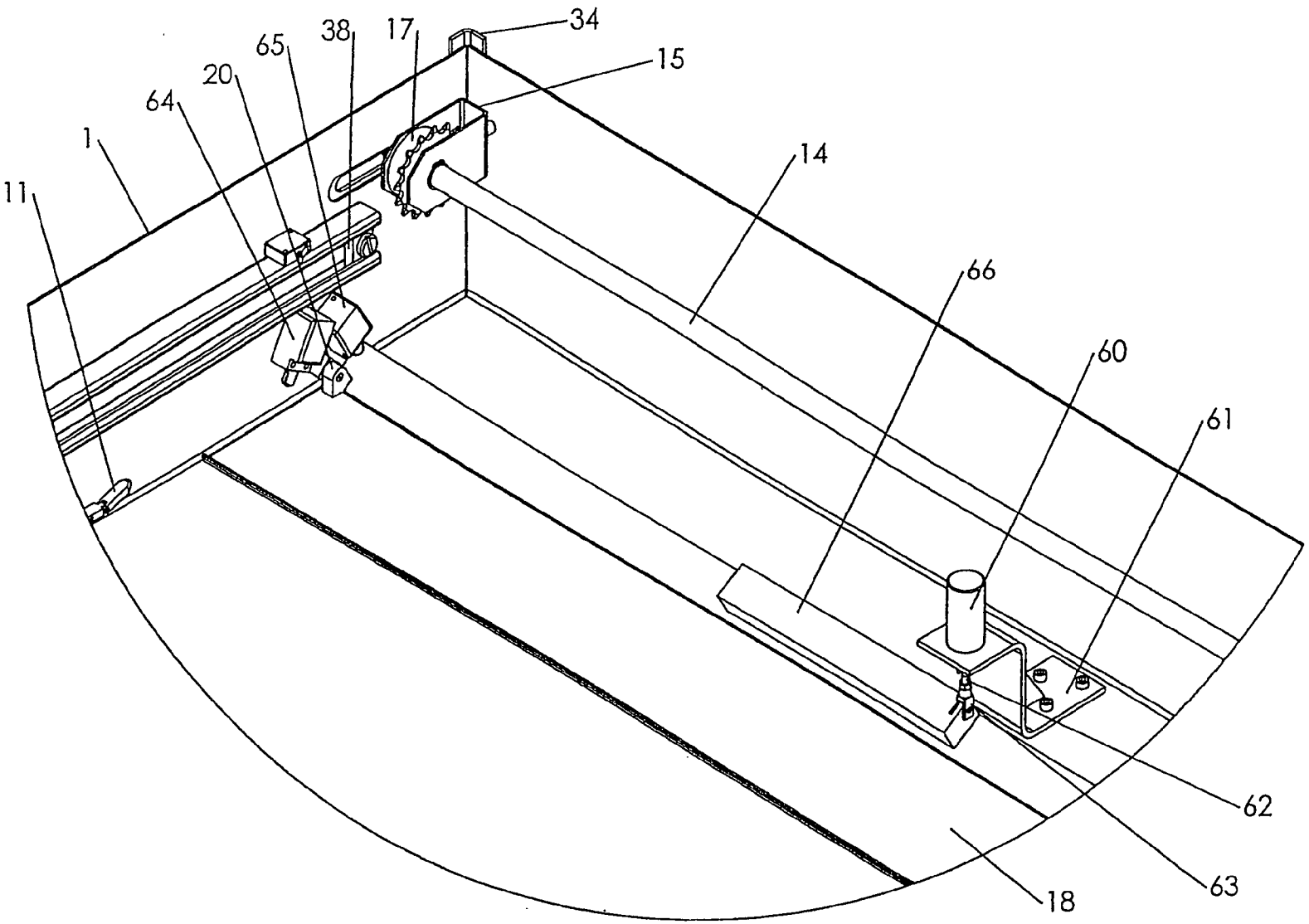
FIG. 11 shows in diagrammatic form a detailed view of a portion of an alternative embodiment.
Figure 12:
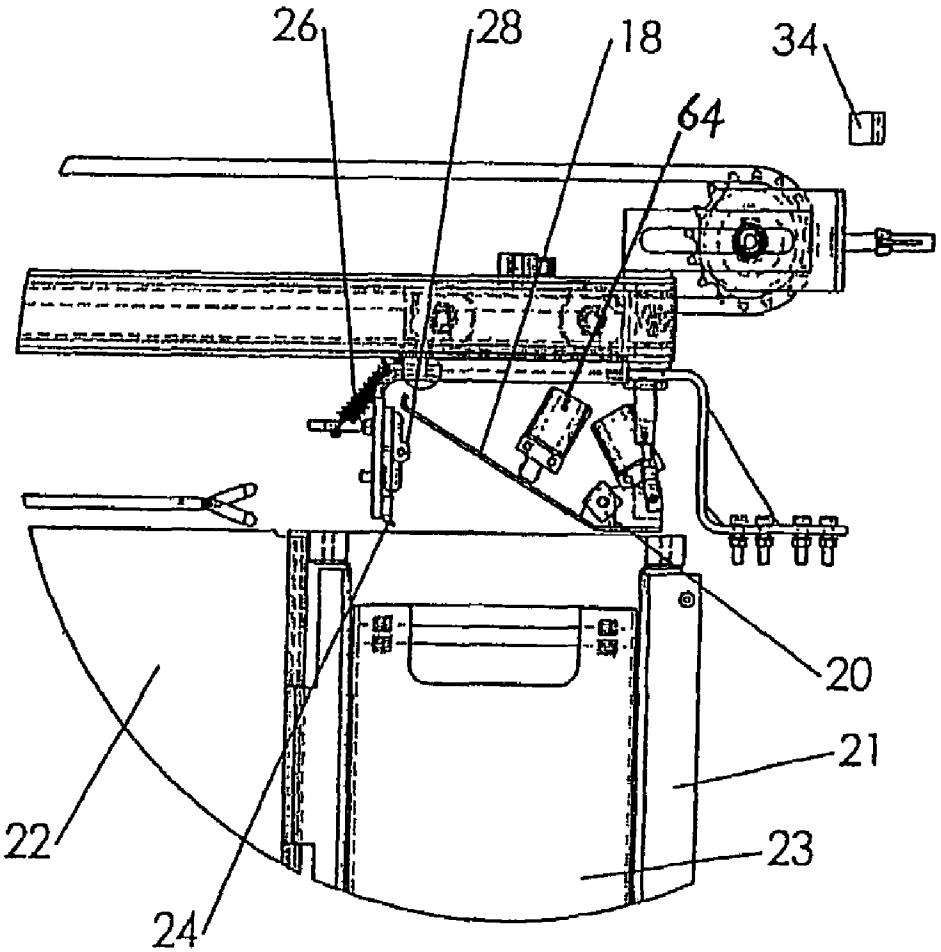
FIG. 12 shows in diagrammatic form a partial side view of the embodiment shown in FIG. 11 in a different operational position thereof.

An alternative embodiment of the apparatus is shown in FIGS. 11 and 12. In this embodiment, the hopper lid 18 is opened and closed by an electro-mechanical solenoid 60. The solenoid 60 is secured to the base of the tray by a solenoid bracket 61. The moving portion of the solenoid 60 is attached to a lid counterweight 66 by a link member 62 attached to clevis members 63 which thereby pivotally attach the solenoid moving member to the counterweight 66. The counterweight is secured to the hopper lid 18 by any suitable means and acts as a balance weight to assist the solenoid in opening the hopper lid 18.

Operation of the solenoid 60 is controlled by the position of the scraper carriage 7. As the scraper carriage 7 commences and finishes its traverse along the tray, so the carriage actuates limit switch 13F. The limit switch 13F in turn signals to the control unit 3 the start and finish sequence of the scraper carriage 7.

At the start and finish sequence of the scraper carriage 7, the control unit signals to the solenoid 60 to open and close the hopper lid 18 in a corresponding sequence, open on start, close on finish.

Position detecting switches 64, 65 are attached to the side of the tray 1 for determining the open or closed status of the hopper lid 18. The switches 64, 65 are used to confirm that the hopper lid 18 is fully open or fully closed in an operational sequence to correspond with the start and stopping sequence of the scraper carriage 7. The switches 64, 65 signal to the control unit 3 the position of the hopper lid 18 which must be open or closed in accordance with the start or finishing sequence of the scraper carriage 7. If for any reason the switches 64, 65 detect that the hopper lid 18 is open or closed out of sequence with the movement of the scraper carriage 7, then the control unit will stop drive to the scraper carriage 7.

FIG. 12 shows a portion of a side view of the alternative embodiment with the hopper lid 18 in an open position having been raised by the solenoid 60 and with the scraper blade 24 located over the removable inner tray 23. This Figure also shows the hopper lid 18 engaging switch 64 which, in turn, indicates to the control unit 3 that the hopper lid is fully open.

The use of a solenoid avoids the requirement of the roller 30 and hopper lid abutment 19 of the first embodiment.

Although the limit switches 13B and 13F and the switches 64, 65 are shown as mechanical switches, it will be appreciated by those skilled in the art that these switches are simply used as position detecting devices and any other suitable form of position detecting device such as photo-optical transmitters and detectors or magnetic sensing devices may alternatively be employed.

The invention claimed is:

1. An apparatus for collecting particulate material comprising:

a collection tray having an opening, a fire resistant collection reservoir located beneath one end of said collection tray and attached thereto in communication with said opening, and moving means for reciprocating movement with respect to the collection tray and the fire resistant collection reservoir for moving particulate material from said collection tray through said opening and into said fire resistant collection reservoir.

2. An apparatus as claimed in claim 1, wherein said reservoir is a container having a selectably operable lid openable for receiving the particulate material into the fire resistant collection reservoir and closable to ensure the collection reservoir is fire resistant.

3. An apparatus as claimed in claim 2, wherein said moving means include a motor driven scraper carriage unit which includes scraper blade means arranged to reciprocatingly move the particulate material from an inside base portion of said tray and into said reservoir.

4. An apparatus as claimed in claim 3, wherein when said scraper blade means is positioned above said reservoir, means are provided for opening said reservoir lid so that the particulate material moved by said scrapper blade is deposited into said reservoir.

5. An apparatus as claimed in claim 4, wherein the means for opening said reservoir lid includes said lid being pivotal and having an abutment member arranged to be contacted by a member attached to said scraper carriage unit for causing said lid to pivotally open.

6. An apparatus as claimed in claim 4, wherein the means for opening said reservoir lid includes said lid being pivotal and arranged to be pivotally opened and closed by electromagnetic means activatable by scraper carriage unit position detecting means.

7. An apparatus as claimed in claim 6, wherein said electromagnetic means is an electrical solenoid coupled with said lid.

8. An apparatus as claimed in claim 4, wherein there is provided detector means to determine the open and closed states of the lid and control means for controlling motion of said moving means whereby, if said lid fails to open or close, movement of said moving means is terminated.

9. An apparatus as claimed in claim 3, wherein when said scraper blade means is above said reservoir and said lid is open, means are provided for cleaning the scraper blade means, whereby the particulate material and dirt therefrom is deposited into said reservoir.

10. An apparatus as claimed in claim 3, wherein when said scraper blade means reciprocatingly re-traverses along said tray away from said reservoir, means are provided for closing said reservoir lid and for lifting said scraper blade means away from said inside base portion of said tray so that the particulate material is not moved in a direction away from said reservoir.

11. An apparatus as claimed in claim 3, wherein when said scraper blade means is arranged to reciprocatingly move the particulate material toward and into said reservoir, means are provided for ensuring rigidity of said scraper blade means.

12. An apparatus as claimed in claim 11, wherein said means are provided for maintaining said scraper blade means orthogonally to the inside base portion of said tray.

13. An apparatus as claimed in claim 1, wherein said reservoir includes a removable collection unit.

14. An apparatus as claimed in claim 1, wherein means are provided for limiting the range of motion of said moving means in a direction of said reciprocating motion.

15. An apparatus as claimed in claim 1, wherein timer means is provided such that said moving means is controllable by said timer means to effect reciprocation of said moving means.

16. A method of collecting particulate material including the steps of:

a) providing a collection tray into which said particulate material is deposited, said collection tray having an opening, b) arranging a fire-resistant collection reservoir beneath one end of said collection tray and attaching thereto in communication with said opening; and c) providing moving means for reciprocating movement with respect to the collection tray and the collection reservoir to move said particulate material from the collection tray through said opening and into said fire-resistant collection reservoir.

17. A method as claimed in claim 16, further comprising providing the collection reservoir with a lid; opening the lid of said reservoir and depositing said particulate into said reservoir.

18. A method as claimed in claim 17 further including a step of lifting said moving means, moving said moving means away from said reservoir and closing said lid.

19. An apparatus for collecting particulate material comprising a collection tray, a fire-resistant collection reservoir associated with said collection tray, and moving means for reciprocating movement with respect to the collection tray and the fire resistant collection reservoir for moving particulate material from said collection tray into said fire-resistant collection reservoir, wherein said moving means include a motor driven scraper carriage unit which includes scraper blade means arranged to move the particulate material from an inside base portion of said tray and into said reservoir and wherein means are provided for opening a reservoir lid of the fire-resistant collection reservoir when said scraper blade means is positioned above said reservoir, so that the particulate material moved by said scrapper blade means is deposited into said reservoir.

* * * * *